United States Patent [19]

Hirano

[11] Patent Number: 4,951,624

[45] Date of Patent: Aug. 28, 1990

[54] IGNITION CONTROL FOR AN ENGINE TO PREVENT OVERHEATING AND BACKFIRING

[75] Inventor: Yoshihide Hirano, Hamamatsu, Japan

[73] Assignee: Sanshin Kogyo Kabushiki Kaisha, Hamamatsu, Japan

[21] Appl. No.: 356,743

[22] Filed: May 24, 1989

[30] Foreign Application Priority Data

May 24, 1988 [JP] Japan ..... 63-126324

[51] Int. Cl.[5] ..... F02B 77/00

[52] U.S. Cl. ..... 123/198 D; 123/335

[58] Field of Search ..... 123/198 D, 198 DC, 425, 123/335, 421, 41.15

[56] References Cited

U.S. PATENT DOCUMENTS

| | | | |
|---|---|---|---|
| 3,158,143 | 11/1964 | Heidner | 123/335 |
| 4,218,998 | 8/1980 | Hill et al. | 123/198 D |
| 4,459,951 | 7/1984 | Tobinaga et al. | 123/198 DC |
| 4,629,471 | 12/1986 | Kurihara et al. | 123/198 D |

*Primary Examiner*—Noah P. Kamen

*Attorney, Agent, or Firm*—Ernest A. Beutler

[57] ABSTRACT

An arrangement for protecting an engine from an abnormal condition such as overheating by slowing of the engine through periodic misfiring of the spark plugs. In order to prevent backfiring, the engine is stopped if the slowed condition is such that backfiring might occur.

4 Claims, 4 Drawing Sheets

IGNITION CONTROL FOR AN ENGINE TO PREVENT OVERHEATING AND BACKFIRING

BACKGROUND OF THE INVENTION

This invention relates to an engine control device for an internal combustion engine and more particularly to an arrangement for slowing the speed of an engine in response to an overheating condition and preventing of backfiring of the engine through its exhaust system when the slowing condition is initiated.

A wide variety of protective devices are provided for internal combustion engines such as spark ignited engines. For example, arrangements have been provided for sensing the operating temperature of the engine and for effecting a slowing of the engine in response to engine temperatures greater than a predetermined value. One popular way in which the engine speed is slowed in response to the sensing of an over temperature condition is by misfiring the spark plugs of the ignition system. Such misfiring will slow the engine speed. An example of an arrangement for slowing the engine under such conditions through misfiring of the spark plugs is disclosed in U.S. Pat. No. 4,459,951, entitled Overheat Preventing System For Internal Combustion Engines, issued July 17, 1984 in the name of Motoi Tobinaga et al. Although such arrangements have particular utility, most engine ignition systems include a spark advance mechanism whereby the time of firing of the spark plug is dependent upon a variety of engine running conditions including engine speed. However, when the engine is slowed by misfiring, the timing may be such that backfires might occur in the engine exhaust system. That is, the delayed timing of the firing of the spark plugs can cause hot gases to issue from the exhaust port of the engine and create a combustion characteristic in the exhaust system commonly known as backfiring or firing back. Such a condition is, obviously, undesirable.

It is, therefore, a principal object of this invention to provide an improved arrangement for protecting an engine in response to a dangerous condition and, at the same time, insuring that backfiring will not occur in the exhaust system of the engine in response to the slowing of the engine.

It is a further object of this invention to provide an improved arrangement for protecting an engine in response to an abnormal running condition and also insuring that backfiring will not occur in that event in the engine exhaust system.

It is a further object of this invention to provide an arrangement for slowing the speed of an engine when an overheating condition occurs and also for insuring that backfiring will not occur in the exhaust system due to the slowing of the speed of the engine.

SUMMARY OF THE INVENTION

This invention is adapted to be embodied in a control for a spark ignited internal combustion engine having an exhaust system and including an ignition circuit for firing a spark plug at a predetermined time in response to the output shaft angle of the engine and the speed of the engine. Means are provided for sensing an abnormal engine condition and for effecting a change in the firing of the spark plug by the ignition circuit in response to the sensing of such an abnormal condition. Means further sense a condition that is likely to cause backfiring in the exhaust system in response to the operation of the means for effecting the change in firing of the spark plug to initiate an operation that prevents such backfiring.

DETAILED DESCRIPTION OF THE PREFERRED EMBODIMENTS OF THE INVENTION

Figure 1:
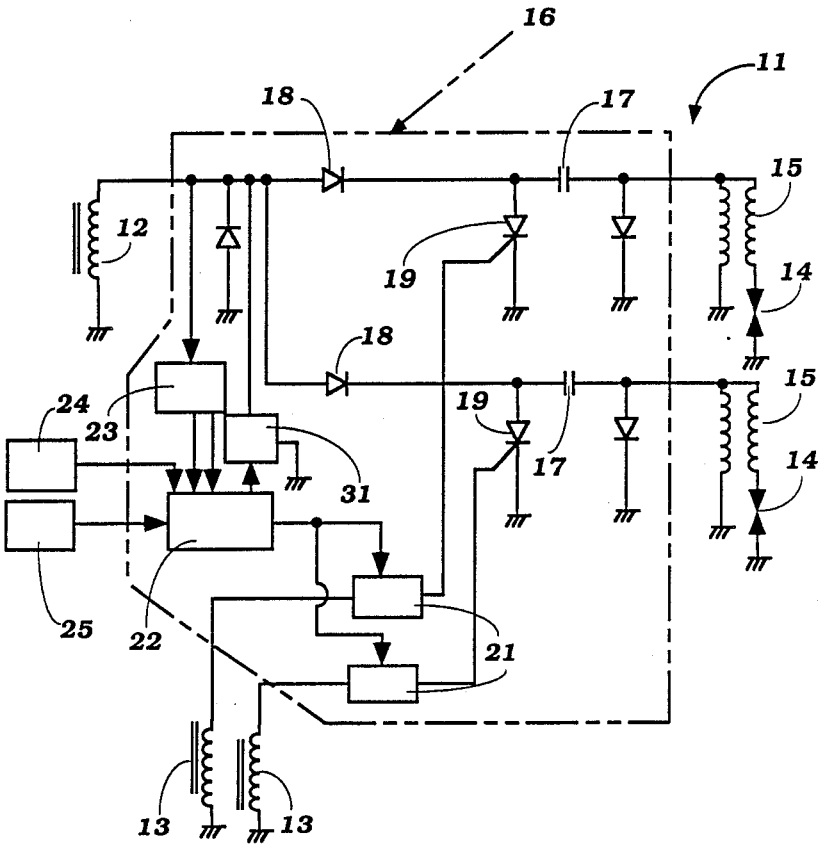
FIG. 1 is a schematic electrical circuit for the ignition system of an internal combustion engine constructed in accordance with a first embodiment of the invention.

Referring first to the embodiment of FIG. 1, the ignition circuit for a two cylinder internal combustion engine is depicted generally by the reference numeral 11. The ignition circuit 11 is particularly adapted for use with outboard motors wherein the engine operates on a two stroke crankcase compression principle. It is to be understood, however, that the invention is capable of use in a wide variety of applications for a wide variety of engines. The invention, however, has particular utility in insuring that the engine, and particularly its exhaust system, will be protected from backfiring conditions when the speed of the engine is slowed due to an abnormal condition, such as an over temperature of the engine, by misfiring of the spark plug so as to protect the engine.

The ignition system 11 includes a magneto generator comprised of a charging coil 12 and a pair of pulser coils 13 for each of a pair of spark plugs 14 of the associated engine. As has been previously described, the number of cylinders employed can be varied without departing from the spirit and scope of the invention and two spark plugs and two cylinders are described only as a typical embodiment of the invention. Spark coils or transformers 15 are associated with each of the spark plugs 14 and have their secondary windings in circuit with the terminals of the spark plug 14 in a known manner. The ignition circuit 11 includes an ignition control system, indicated generally by the reference numeral 16 for operating a conventional type of SCR ignition circuit. The charging coil 12 charges a charging capacitor 17 associated with each of the spark coils 15 and specifically the primary windings thereof through a respective rectifying diode 18. There is provided a thyristor 19 in circuit with the charging capacitor 17 and a ground circuit. As is well known, the charging capacitor 17 is charged during the rotation of the output shaft of the engine and when the thyristor 19 is grounded by rendering its gate conductive, the capacitor 17 will discharge and generate a voltage in the secondary windings of the spark coils 15 for firing the spark plugs.

The gates of the thyristors 19 are controlled by means of gate circuits 21 that receive outputs from the pulser coils 13 so as to render the thyristors 19 conductive at the appropriate crank angle so as to fire the spark plugs. The gate circuits 21 are further controlled by an ignition timing operation circuit 22 which, under normal running conditions, sets the spark timing in relation to various engine parameters such as actual engine speed as sensed by a speed sensing circuit 23, which may sense speed as a function of the output of the charging coil 12. There is also provided a setable speed signal 24 which supplies a signal to the control circuit. Except for the signal 24, the construction of the ignition circuit 11 as thus far described may be considered to be conventional and, for that reason, further description of it is believed to be unnecessary in order to understand the construction and operation of the invention.

In accordance with the invention, there is further provided a device for protecting the associated engine in the event of an overheating condition. To this end, there is provided a temperature detector 25 which outputs a signal to the ignition timing operation circuit 22 so as to slow the speed of the engine in response to the sensing of a temperature greater than a predetermined temperature. This is done by misfiring the spark plugs in a manner as described in aforenoted U.S. Pat. No. 4,459,951 or as will be described in conjunction with the embodiment of FIGS. 2 and 3. Basically, this is done by effecting a misfiring of the spark plugs 14 so that they will not fire during every revolution of the engine crankshaft (remembering that a two cycle engine operation is being referred to). However, other forms of protective arrangements for slowing the engine speed may be utilized.

As the engine is slowed by the misfiring of the spark plugs, the timing circuit will also tend to retard the spark timing and this combined effect may cause a condition known as backfiring and, as aforedescribed, to occur in the exhaust system of the engine. In order to prevent this condition, there is provided a protective arrangement that operates in accordance with the sequence as shown in FIG. 4.

Figure 4:
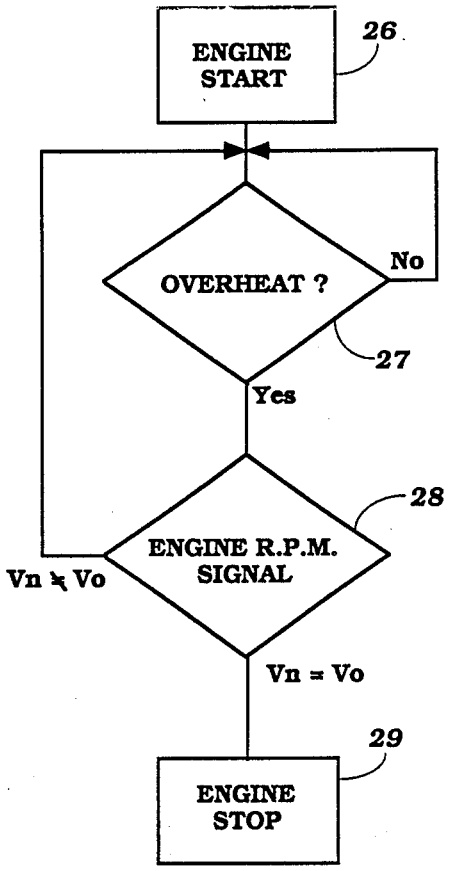
FIG. 4 is a block diagram showing the sequence of operation in the logic of the embodiments of the invention.

Referring now to FIG. 4, it will be seen that at the block 26 the running of the engine is determined. Then at the block 27, it is determined whether or not the temperature sensor 25 has indicated an over temperature sensing condition. If it has not, then the program turns back and repeats.

If, however, at the step 27 it has been determined that there is an over temperature condition, the program moves to the step 28 wherein the ignition timing operation circuit 22 or a portion of it makes a determination to determine if the engine speed $V_n$ is greater than an engine speed $V_o$ at which backfiring may occur as set in the signal device 24. If the engine speed is above the speed $V_o$, then the program will again repeat.

If, on the other hand, it is determined that the engine speed is equal to or below the speed at which misfiring may occur ($V_o$) then the engine will be stopped at the step 29 by energizing an engine kill circuit 31 (FIG. 1). The engine kill circuit 31 is effected to ground the output of the charging coil 12 so that the charging capcitor 17 will not be charged and that firing cannot occur.

Once the engine has been returned to its normal condition, it will, of course, be possible for the operator to restart the engine.

Figure 2:
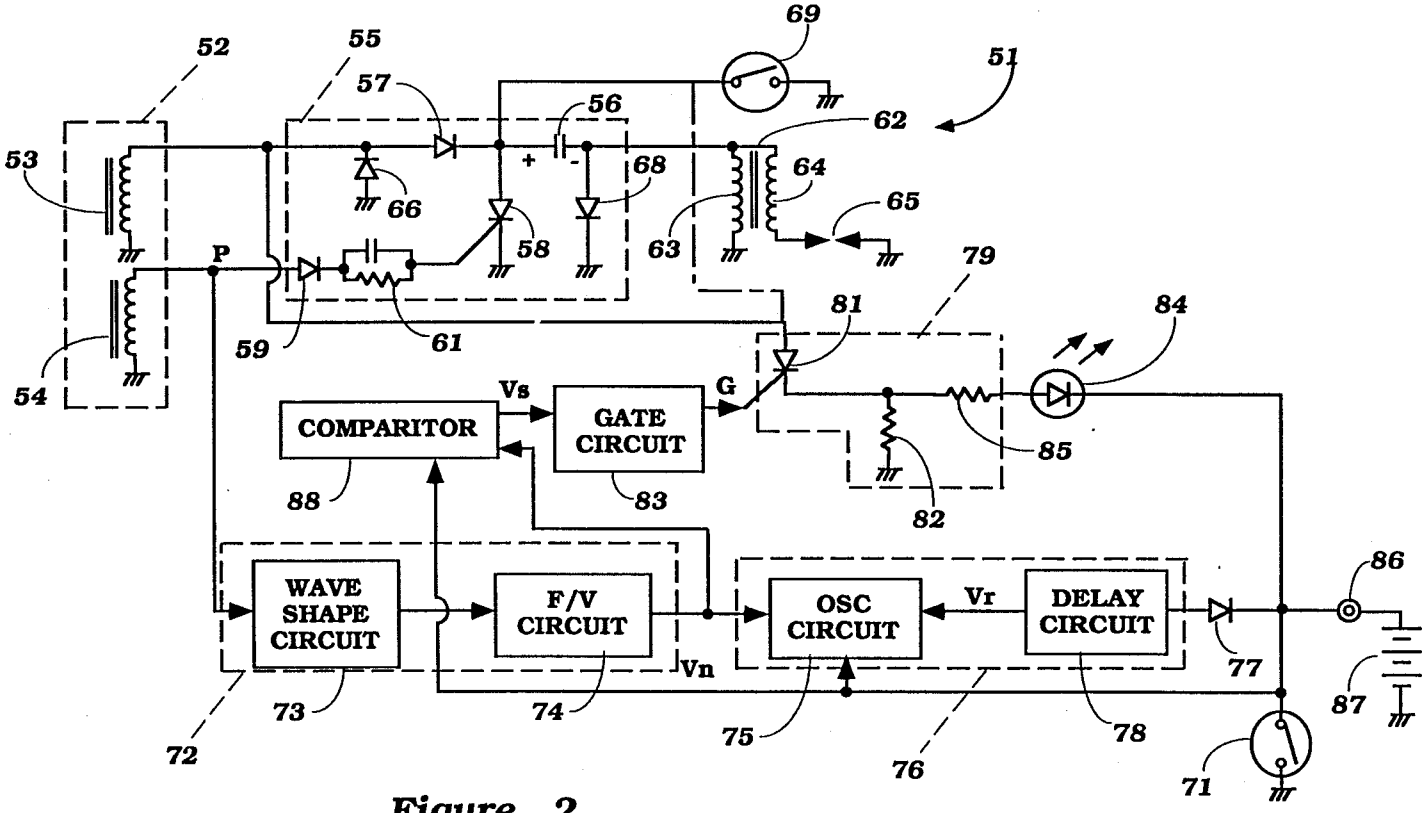
FIG. 2 is a schematic electrical diagram for the ignition circuit constructed in accordance with a second embodiment of the invention.

Referring now to FIG. 2, a second embodiment of the invention is identified generally by the reference numeral 51. This embodiment is depicted in conjunction with a single cylinder engine, however, as aforenoted, the invention can be practiced in conjunction with engines having any number of cylinders or spark plugs.

The engine 51 includes a magneto generator 52 that includes a charging coil 53 and a pulser coil 54. The charging coil 53 and pulser coil 54 output their signals to a capacitor discharge ignition circuit, indicated generally by the reference numeral 55. This circuit 55 includes a charging capacitor 56 that is charged from the charging coil 53 through a rectifying diode 57. As aforenoted, the charging capacitor 56 is charged during the rotation of the crankshaft. At the appropriate crankshaft angle, as determined by the output from the pulser coil 54, an SCR 58 and specifically its gate is rendered conductive by means of a circuit including a diode 59 and capacitor resistor circuit 61 so as to ground the charging capacitor 57. When this occurs, a spark coil 62 will have a voltage induced in its primary winding 63 which is magnified in the secondary winding 64 for firing a spark plug 65 in a known manner. A diode 66 is placed between the charging coil 53 and diode 57 for providing a circuit during the negative half way of the charging coil 53. A similar diode 68 is provided in the circuit between the charging capacitor 56 and the primary winding 63 of the ignition coil and the ground.

There is also provided a kill switch 69 that is in circuit between the charging coil 56 and the ground for grounding the charging circuit to the charging coil 56 and stopping of the engine under the operator control.

Like the circuit of FIG. 1, the ignition system 51 is provided with an arrangement for slowing the speed of the engine by misfiring of the spark plug 65 in response to an overheated condition as sensed by a temperature sensing switch 71 which closes a circuit and grounds in response to an over temperature condition. This protection circuit includes an engine speed detecting circuit 72 that is in circuit with the output from the pulser coil 54 and which includes a wave shaper circuit 73 that provides an output wave form containing a number of pulses indicative of engine speed. This is outputted to a frequency to voltage converter circuit 74 which outputs a voltage $V_n$ indicative of engine speed.

Figure 3:
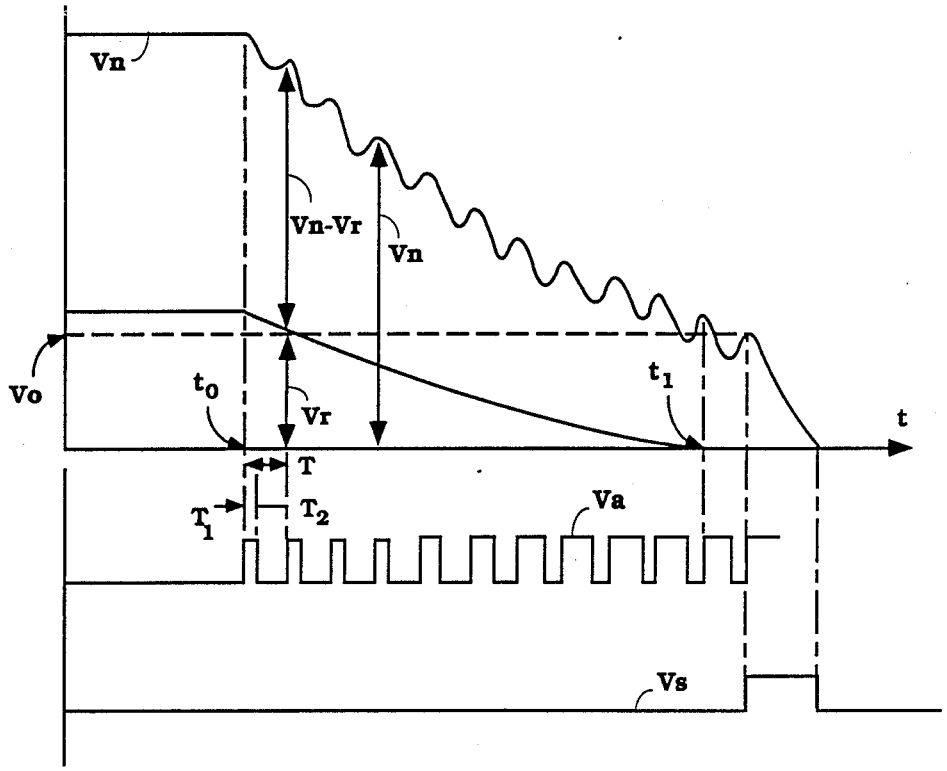
FIG. 3 is a graphical view showing the operation of the embodiment of FIG. 2.

The frequency to voltage converter 72 outputs its signal to an oscillator circuit 75 of an ignition timing operation circuit 76. The ignition timing operation circuit 76 is designed so as to cause the spark plug 65 to be not fired for increasing time intervals during a given period of time so that the spark plug 65 will fire only once every several revolutions of the engine until the speed is reduced to a level where the engine will be protected. The transmission of speed signal $V_n$ to the oscillator circuit 75 occurs only when the temperature switch 71 is closed. This causes power to be delivered through a diode 77 to a delay circuit 78 that has an output $V_r$ that is also delivered to the oscillator circuit 75. The time delay circuit 78 operates like a capacitor in that its output signal $V_r$ decays along a curve as shown in FIG. 3.

The oscillator circuit 75 has an output voltage $V_a$ that is generated for a time period which is varied in accordance with the difference between the voltages $V_n$ and $V_r$. The output of the oscillator circuit 75 is shown on the curve of FIG. 3 wherein the output extends for a period $T_1$ during a preset time interval T. As may be seen from this figure, the time $T_1$ continues to increase until the voltage $V_r$ has decayed to the point $t_1$ at which it is held constant for a fairly substantial time period. During the time $T_1$ when the oscillator 75 is providing its high output, the firing of the spark plug 65 will be disabled.

This disabling is achieved by providing a shunting circuit that prevents charging of the capacitor 56. This shunting circuit is indicated generally by the reference numeral 79 and includes and SCR 81 that has its output connected to a ground by means of a circuit including a resistor 82. The SCR 81 has its gate controlled by means of a gate circuit 83 which receives the output from the oscillator circuit 75 and which energizes the gate of the SCR 81 for a time $T_1$ as set by the oscillator circuit 75. An LED 84 is illuminated at this time through a resistor circuit 85 as well as sounding of a buzzer 86 powered by a battery 87 so as to provide the operator with an indication that an over temperature condition has existed and the engine is being slowed.

In order to insure that the engine will not encounter a backfiring condition, there is further provided a comparator 88 that outputs a signal $V_s$ to the gate circuit 83 so as to stop the engine by the permanent grounding of the circuit by permanently switching the SCR 81 on to ground it. The comparator 85 compares the speed signal $V_n$ with a predetermined voltage $V_o$ which is imposed upon it in a suitable manner, so as to switch the engine off when the speed falls to the speed at which backfiring may occur.

It should be noted that, like the preceding embodiment, the engine can be restarted once it has been stopped, but when the overheating condition is still present, the engine will again be stopped when the speed of the engine will become equal to the speed at which misfiring may occur.

It should be readily apparent from the foregoing description that a number of embodiments of the invention have been illustrated and described, each of which is effective to insure that backfiring will not occur in an engine even when the engine speed is being slowed due to an abnormal running condition. Although two embodiments of the invention have been illustrated and described, various changes and modifications may be made without departing from the spirit and scope of the invention, as defined by the appended claims.

I claim:

1. In a control for a spark ignited engine having an exhaust system comprising an ignition circuit for firing a spark plug at a predetermined time in response to the output shaft angle of the engine and the speed of the engine, means for sensing an abnormal engine condition, means for effecting a change in the firing of said spark plug by said ignition circuit in response to the sensing of an abnormal condition for slowing the speed of the engine, and means for sensing a condition likely to cause backfiring in said exhaust system in response to the operation of the means for effecting the change in the firing of said spark plug to initiate an operation of the engine to prevent such backfiring.

2. In a control for a spark ignited engine as set forth in claim 1 wherein the abnormal condition is a temperature of the engine above a predetermined temperature.

3. In a control for a spark ignited engine as set forth in claim 2 wherein the means for preventing backfiring stops the engine.

4. In a control for a spark ignited engine as set forth in claim 1 wherein the means for preventing backfiring stops the engine.

* * * * *